United States Patent [19]

Köhler

[11] 3,986,434

[45] Oct. 19, 1976

[54] HYDRAULIC SWIVEL DRIVE FOR ACTUATION OF A PIVOTALLY MOUNTED MEMBER

[75] Inventor: Karl Albert Köhler, Vellmar, Germany

[73] Assignee: Rheinstahl AG, Essen, Germany

[22] Filed: Mar. 17, 1975

[21] Appl. No.: 559,245

[30] Foreign Application Priority Data

Mar. 18, 1974 Germany ..... 2412943

[52] U.S. Cl. ..... 91/178; 91/186; 91/461; 92/146; 92/172

[51] Int. Cl.[2] ..... F01B 1/04; F15B 11/16

[58] Field of Search ..... 91/186, 178; 92/68, 92/146, 147, 161, 261, 149

[56] References Cited

UNITED STATES PATENTS

| | | | |
|---|---|---|---|
| 530,400 | 12/1894 | Devoissand | 91/186 |
| 2,519,106 | 8/1950 | Bobard | 92/68 |
| 2,859,592 | 11/1958 | Mercier et al. | 91/186 |
| 3,125,000 | 3/1964 | Reuter | 91/186 |
| 3,434,387 | 3/1969 | Ellis | 92/68 |
| 3,490,339 | 1/1970 | Baltus | 91/186 |
| 3,817,150 | 6/1974 | Cox | 91/186 |

*Primary Examiner*—Paul E. Maslousky
*Attorney, Agent, or Firm*—Walter Becker

[57] ABSTRACT

A hydraulic swivel drive with two adjusting cylinder-piston systems the connecting rods of which are pivotally connected to a pivotally mounted member to be actuated by the hydraulic swivel drive. The cylinder-piston units are mounted on a base member, e.g. a base plate, which base member is provided with a servo-valve controlling the supply of actuating fluid to the cylinder-piston units which are arranged in V-formation and are hooked up with the pivotally mounted member so as to be symmetrically arranged with regard to the pivot axis of the pivotally mounted member. The cylinder-piston units are directly connected to the base member and their connecting rods are pivotable relative to the axis of their pertaining cylinder.

16 Claims, 7 Drawing Figures

HYDRAULIC SWIVEL DRIVE FOR ACTUATION OF A PIVOTALLY MOUNTED MEMBER

The present invention relates to a hydraulic swivel drive with two single acting adjusting cylinder piston systems which are arranged on a base plate and the connecting rods of which are pivotally connected to the object to be pivoted, especially for aiming or sighting and/or stabilizing guns and/or gun turrets and aircraft swivel turrets.

A device for stabilizing a turret by means of measuring elements and adjusting drives has become known in connection with armored vehicles, according to which drives comprising pistons and cylinders are controlled through amplifiers by starting signals emitted by gyroscopes serving as measuring members.

Drives of this type nowadays have to meet rather high requirements with regard to a high acceleration as well as with regard to a fast braking of the considerable masses to be moved. Furthermore, such drives must have a high fundamental frequency or high compensating or equalizing time in order to assure that they will be able possibly directly to follow the adjusting signals from the sighting or aiming position and/or of the stabilizing control device.

In addition to hydromotors the unlimited rotatability is preferably used for lateral aiming devices with guns and/or gun turrets and aircraft weapon turrets, frequently the structural more simple double-acting adjusting cylinder piston systems are employed for limited swivel movements such as height aiming devices, while the movements of such double-acting adjusting cylinder piston systems are controlled by means of a servo valve.

The compensating time $T$ of such system is approximately obtained from the following formula:

$$T = \frac{V_{max}}{b}$$

In other words, this formula expresses the up-take time to the maximum adjusting speed $V_{max}$ at constant acceleration b of a compensating or substitute mass $m$ — the kinetic energy of which equals the kinetic energy of all moved masses — due to the pressure p acting upon the piston surface $F_c$ of the adjusting cylinder.

$$\text{Since } b = \frac{P \times F_c}{m},$$

$$T = \frac{V_{max}}{P \times F_c} \times m$$

During a power stabilizing operation for instance without aiming operations, when the gun and the gun turret stay at rest, and only the carrier vehicle therebelow moves, the term "moved masses" is intended to indicate the masses of the oil in the adjusting cylinder as well as in the feeding from the servo valve to the adjusting cylinders.

The pertaining substitute mass m, however, amounts to a multiple of these moved masses, because according to the continuity condition, the oil velocities in the adjusting cylinders and in the feeding line change inversely with regard to the clear cross sections of said adjusting cylinders so that the following formula is obtained:

$$m = m_c + m_l \times \left(\frac{F_c}{F_l}\right)^2$$

$$m = m_c \left(1 + \frac{L_l}{L_c} \times \frac{F_c}{F_l}\right)$$

In this formula, $m$ stands for the mass, $F$ stands for clear cross section, $L$ stands for length, index $c$ stands for cylinder and index $l$ stands for the feeding line.

With double-acting adjusting cylinders, the feeding lines lead from the servo valve to the two cylinder ends so that the total length of the feeding lines corresponds approximately to the length of the cylinders. Moreover, this design is rather expensive, and the connecting rod requires a precise journalling.

It is, therefore, an object of the present invention with a hydraulic swivel drive of the above mentioned type to decrease the substitute mass in order thereby to increase the dynamics of the swivel drive, and to bring about the power transmission by as simple means as possible.

These and other objects and advantages of the invention will appear more clearly from the following specification in connection with the accompanying drawings, in which.

Figure 7:
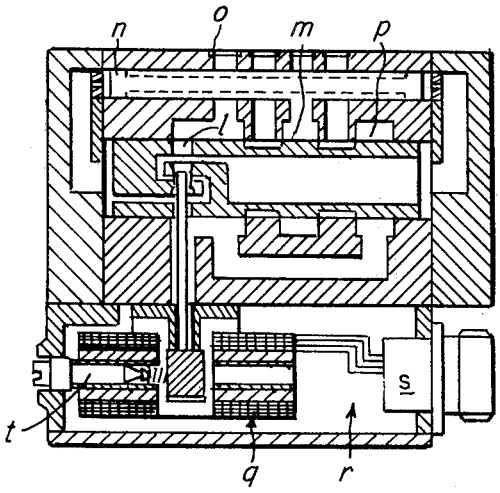
Figure 6:
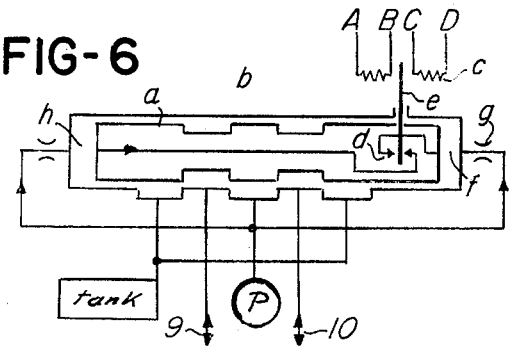

FIGS. 6 and 7 respectively show the servo-valve as to its principle and in section.

The hydraulic swivel drive according to the invention which comprises two single acting adjusting cylinder piston systems which are arranged on a base plate and the connecting rods of which are pivotally connected to the object to be pivoted, is characterized primarily in that the base plate is rigidly connected to the pivot axle and is provided with a servo valve for the two adjusting cylinder piston systems which are arranged in V formation and symmetrically to the pivot axle and which are acted upon by a pressure fluid on one side, and which are directly mounted on a base plate. The hydraulic swivel drive according to the invention is furthermore characterized in that the connecting rods are pivotable relative to the longitudinal axis of the cylinders.

According to an advantageous further development of the invention, the cushioning chambers which precede the pressure chambers of the adjusting cylinder piston systems, and the conduits establishing communication between the cushioning chambers and the servo valve, are arranged in the base plate which latter simultaneously closes the two adjusting cylinder piston systems. The swivel drive according to the invention brings about in an advantageous manner that the feeding lines from the servo valve to the two cylinders of the two adjusting cylinder piston systems are reduced in length, and the adjusting cylinder piston systems can due to their V-shaped arrangement and the fact that they are unilaterally acted upon, be designed without special guiding means for the pistons.

A preferred embodiment of the invention consists in that the base plate is non-rotatably connected to two oppositely located arms which in their turn are connected to the swivel axle. This connection is effected by means of a bolt arranged at the point of intersection of the extended longitudinal axes of the adjusting cylinder piston systems and the extension of said bolt perpendicular thereto.

A further advantageous development of the invention consists in that the base plate rests on a support which is connected to the swivel axle.

The two adjusting cylinder piston systems may be arranged at an angle of from 0 to approximately 180° while the servo valve is either below said base plate or laterally of or between said adjusting cylinder piston systems connected to said base plate.

Another advantageous design of the present invention is characterized in that that end of the connecting rod which faces toward the respective piston has a ball head by means of which said connecting rod is journalled in a corresponding socket in the piston which advantageously may have two sections.

However, the piston may also be designed as a single piece and may be provided with a crowned circumferential surface while forming a single structural unit with the connecting rod.

Figure 1:
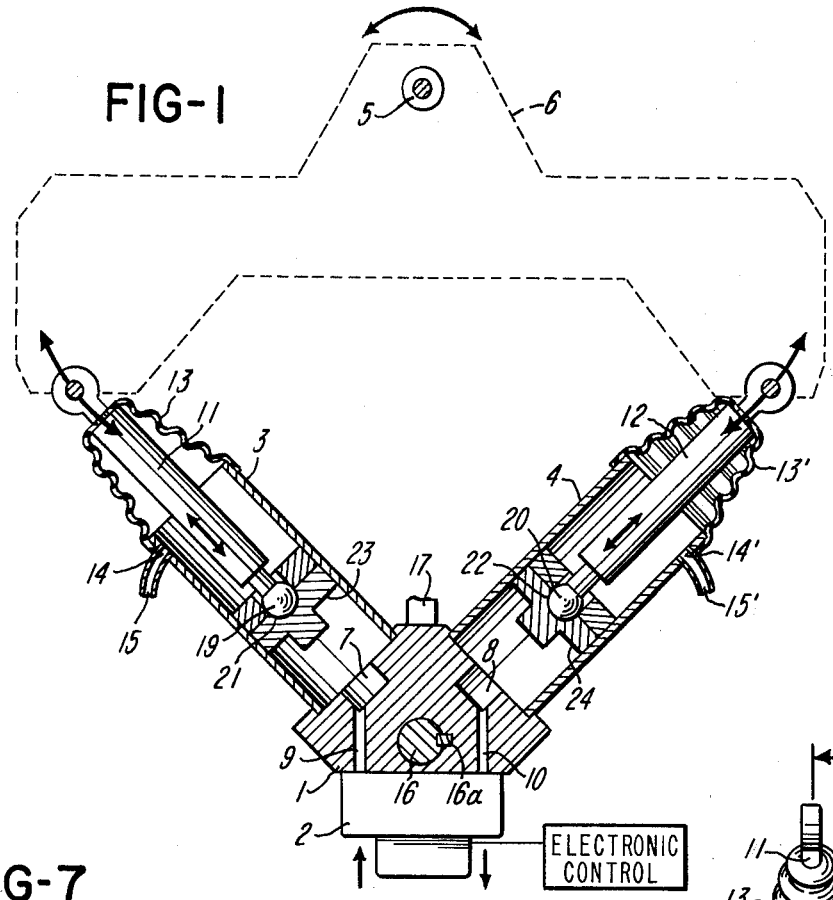
FIG. 1 is a section taken along the line I—I of FIG. 2 with adjusting cylinder piston systems in V arrangement and suspended, while the servo valve is located below the cylinder piston systems, and the connecting rod has a ball head, and the piston is a two-sectional piston.
Figure 2:
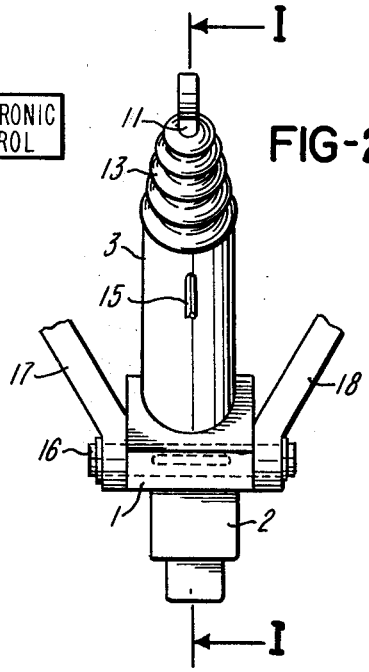
FIG. 2 is a side view of FIG. 1.

Referring now to the drawings in detail, a hydraulic swivel drive according to the inventon consists primarily of a base plate 1 to which are connected a servo valve 2 as well as two unilaterally acted upon adjusting cylinder piston systems 3 and 4 in V-shaped arrangement and located symmetrically to the pivot axle 5 of the object 6 to be moved which may be a structural element of the swivel drive, a gun, or a gun turret or an aircraft weapon turret. The two cylinders 3 and 4 may be arranged at an angle of from 0° to nearly 180° and are directly connected to the base plate 1 which simultaneously closes the cylinder piston systems. In said base plate 1 there are provided cushioning chambers 7, 8 which precede the pressure chambers of the cylinders 3 and 4 and serve for cushioning the end position of the pistons in their pertaining cylinders. Furthermore located in said base plate 1 are feeding lines 9, 10 leading from the servo valve 2 to said cushioning chambers 7, 8. Each connecting rod 11, 12 of the pertaining cylinder piston system 3, 4 is pivotally connected to the object 6 to be swiveled but is not journalled in the cylinder so that they will be able without friction to convert the rectilineal movement of the piston into a swivel movement of the object 6 and will be able to occupy a position which deviates from the longitudinal axis of the cylinder. With each cylinder piston system 3, 4, the annular opening between the cylinder wall and the connecting rod 11, 12 is closed toward the outside for instance by a bellows 13, 13'. In order to assure that the leakage which collects in the cylinder above the piston will be able to flow off, the cylinder wall is provided with a bore 14, 14' connected to a conduit 15, 15'. Furthermore, safety valves, short circuit valves or the like (not illustrated) may be arranged on or in the base plate 1. According to the embodiment of FIGS. 1 and 2, the servo valve 2 is located below the base plate 1. The base plate 1 is suspended on two arms 17 and 18 which extend in the vertical plane of the swivel axis 5.

This suspension is effected by means of a bolt 16 arranged in the point of intersection of the extended cylinder axes and non-rotatably connected to the base plate 1 through the intervention of a key 16*a*. The arms 17 and 18 may be connected either to a rotatable portion of an azimuth bearing (not shown) or to the pivot axle 5.

In order to assure that the base plate 1 cannot turn around the bolt 16, there may be provided any suitable standard safety arrangement. Each connecting rod 11, 12 has a ball head 19, 20 by means of which the respective connecting rod is journalled in a pertaining socket 21, 22 in piston 23 and 24 respectively. These pistons 23, 24 are advantageously composed of two sections.

Figure 3:
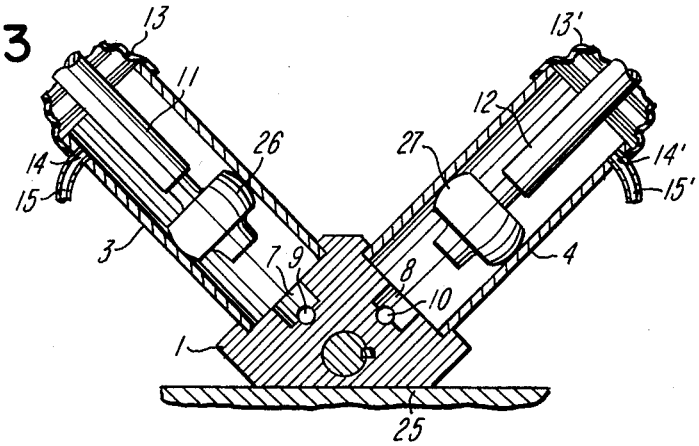
FIG. 3 shows an arrangement similar to that of FIG. 1 but supported from below and with laterally arranged servo valve and with the pistons designed as crowned pistons.
Figure 4:
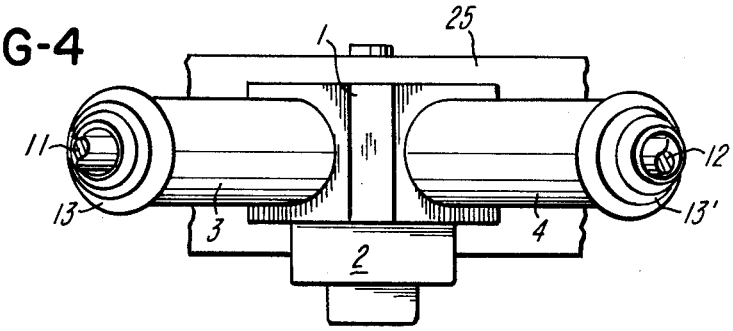
FIG. 4 is a top view of FIG. 3.

With the swivel drive according to FIGS. 3 and 4, the base plate 1 rests on a support 25 which is connected either to a rotatable part of an azimuth bearing or to the base plate 1. Each of the pistons 26, 27 respectively pertaining to the adjusting cylinder piston systems 3, 4 has a crowned circumferential surface and forms a structural unit with the pertaining piston rod 11, 12.

Figure 5:
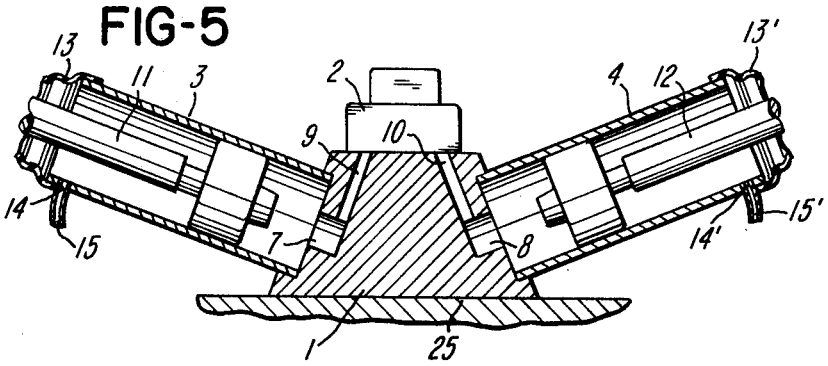
FIG. 5 shows a section similar to that of FIG. 3 with a servo valve arranged above the adjusting cylinder pistons.

FIG. 5 shows a modified swivel drive according to which the base plate 1 likewise rests on a support 25 while the servo valve 2 is between the two cylinder piston systems 3 and 4 connected to the base plate 1.

FIG. 6 illustrates the principle of the servo-valve 2. In the electrical part the inlet magnitude (difference between two direct electric currents) is first converted into a mechanical stroke of the lever *e*. This lever movement is transferred to the control piston *a* which at its control edge *b* doses the oil flow. However, since the adjusting force of lever *e* is low, it is increased in a hydraulic preamplifier so that the control piston *a* will be displaced by a sufficient force and with precision. If, e.g. the current increases in coil *c*, lever *e* pivots in clockwise direction. The lower lever end moves toward the left (with regard to the drawing), whereby the outlet cross section of nozzle *d* will be reduced. As a result thereof, the pressure in chamber *f* increases because the oil will from its pressure system flow through the feeding orifice *g*. Whereas previously the same pressure prevailed in the two chambers *f* and *h*, the equilibrium is now disturbed, and piston *a* moves toward the left (in the drawing). The nozzle opening then increases again until a new equilibrium is established. This happens as soon as pisotn *a* carries out the same stroke a lever e. The last mentioned piston stroke brings about that oil under pressure flows from the supply system P (pump) into the control system 10. A the same time oil flows from the central system 9 into a tank.

FIG. 7 shows an embodiment of the servo-valve shown in principle only in FIG. 6. More specifically, the reference character 1 represents the hydraulic pilot control stage directly in the piston so that short symmetric pilot control conduits are obtained. No mechanical connection exists between the piston and the magnetic system. The control edges *m* of piston and cylinder are hardened, ground and laped. In front of the orifices an easily accessible fine screen *n* is provided. O-ring *o* permit a fast and well sealed mounting of the servo valve on the plate or block 1. The piston bore *p* is a continuous bore free from any guiding steps.

The device of FIG. 6 also includes a rigid, well damped magnetic system assuring good dynamic properties. The electric part, generally designated *r*, is separated from the oil and is dust-tight sealed from the outside. The reference character s designates the electrical connection of the servo-valve, and, finally, the reference character *t* designates a means for setting the zero point from the outside.

The advantages realized by the present invention consist primarily in an improvement of the functions because the shorter compensating period or the higher fundamental frequency of the drive also permits a higher stabilizing precision. In addition thereto, an advantage of the invention is seen in the simplification of the drive because the cylinders are only simple bushings inserted in the base plate, and the base plate takes over the sealing function of the cylinder closing cover.

Furthermore, a journalling of the connecting rod is no longer necessary which heretofore required increased manufacturing precision or special structural steps as for instance a floating piston and a very fine machining.

In connection with the present invention, there is also to be mentioned a further advantage which consists in the central location of the base plate which offers a plurality of space saving and with regard to the assembly, favorable possible variations for the connection of the swivel drive and the arrangement of other elements such as short circuit valve, pressure valve, pressure measuring devices, etc.

It is, of course, to be understood that the present invention is, by no means, limited to the specific showing in the drawings, but also comprises any modifications within the scope of the appended claims.

What I claim is:

1. A hydraulic swivel drive for actuation of means including a pivotally mounted member having a pivot axis, which includes: in combination therewith: base means having at least three angularly located side surfaces, two fluid operable cylinder-piston units arranged in narrow in V-formation relative to each other and including cylinders therewith rigidly connected with ends thereof mounted on the base means closely adjacent to each other and supported by at least two of the side surfaces of said base means, the pistons of said two cylinder-piston units respectively being reciprocable in said cylinders, two connecting rods respectively associated with said cylinder-piston units, said connecting rods respectively having one end portion pivotally connected to said pistons and having their other end portion respectively pivotally connectable to two points on opposite sides of the pivot axis of said pivotally mounted member to be actuated by said swivel drive, said base means comprising a plurality of short conduit means communicating directly with both said cylinders to receive and convey minimum actuating fluid into the respective cylinder for acting upon that piston surface which faces toward said base means, and valve means likewise arranged directly on said base means and operable to control the supply of actuating fluid through said short conduit means into the respective cylinder-piston unit.

2. A swivel drive in combination according to claim 1, in which each of said pistons has a socket having arranged therein a ball head forming part of said one end portion of the pertaining piston.

3. A swivel drive in combination according to claim 2, in which each of said sockets is composed of two sections.

4. A swivel drive in combination according to claim 1, in which said valve means is a servo-valve adapted to be connected to and to be controlled by sensor means.

5. A swivel drive in combination according to claim 1, in which said conduit means are arranged within said base means and in which that end of said cylinders which is adjacent said base means is closed by said base means.

6. A swivel drive in combination according to claim 1, in which said base means is adjacent said cylinders provided with recess means respectively communicating with one of said conduit means and with the respective adjacent portion of the respective adjacent cylinder.

7. A swivel drive in combination according to claim 1, which includes bolt means fixedly connected to and extending through said base means at the point of intersection of the longitudinal axes of said cylinder-piston units and in a direction transverse to the longitudinal direction of said longitudinal axes, and holding means arranged at opposite ends of said bolt means for suspension on the pivot axis of said pivotally mounted member to which said other end portions of said connecting rods are connectable.

8. A swivel drive in combination according to claim 1, which includes bellows means respectively surrounding said other end portions of said connecting rods.

9. A swivel drive in combination according to claim 1, which includes a support supporting said base means and connectable to the pivot axis of said pivotally mounted member to which said other end portions of said connecting rods are connectable.

10. A swivel drive in combination according to claim 1, in which the longitudinal axes of said cylinder piston units form with each other an angle within the range of from slightly over 0° to nearly 180°.

11. A swivel drive in combination according to drive 1, in which said valve means is connected to the bottom surface of said base means.

12. A swivel drive in combination according to claim 1, in which said valve means is connected to the top surface of said base means.

13. A swivel drive in combination according to claim 1, in which said valve means is connected to a lateral surface of said base means.

14. A swivel drive in combination according to claim 1, in which each of said pistons consists of a single piece and forms with the pertaining connecting rod a structural unit.

15. A swivel drive in combination according to claim 14, in which each of said pistons has a crowned circumferential surface.

16. A swivel drive in combination according to claim 1, in which said cylinders and said valve means are fixedly connected to said base means.

* * * * *